US005295336A

United States Patent [19]

Egaas

[11] Patent Number: 5,295,336

[45] Date of Patent: Mar. 22, 1994

[54] RELEASABLE POST ANCHORING DEVICE

[76] Inventor: Roy B. Egaas, 11330 Madison Ave. NE., Bainbridge Island, Wash. 98110

[21] Appl. No.: 48,796

[22] Filed: May 12, 1987

[51] Int. Cl.[5] ..... E02O 5/74

[52] U.S. Cl. ..... 52/166; 52/98

[58] Field of Search ..... 52/98, 99, 166, 153, 52/154, 155

[56] References Cited

U.S. PATENT DOCUMENTS

| | | | |
|---|---|---|---|
| 1,025,823 | 5/1912 | Morrow | 52/166 |
| 3,698,144 | 10/1972 | Stratton | 52/99 |
| 3,769,768 | 11/1973 | Bertrand | 52/98 X |
| 4,106,879 | 8/1978 | Diedershagen et al. | 404/10 |
| 4,236,843 | 12/1980 | Chisholm | 52/98 X |
| 4,522,530 | 6/1985 | Arthur | 404/10 |
| 4,553,358 | 11/1985 | Deike | 52/98 |

*Primary Examiner*—Michael Safavi
*Attorney, Agent, or Firm*—Harry M. Cross, Jr.

[57] ABSTRACT

Post anchoring and quick release device (10) having a lower post attachment section (20) and an upper anchoring section (22). the device (10) is an elongated, generally rectangular body having in the lower section at least one opening (40,42) in one configuration and at least one opening (66,68) in another configuration and a nail hole (48,50,74,76) beneath each said opening. The nail holes are separated from the openings either by a web (52,54) or a restricted slit (78,80). The device is attached to a post by nails and when the post is to be removed from the ground a bar (B) is used to strike an offset release surface (28) to rupture the web against the nail or to allow the nail so slide through the restricted slit (78,80). In the one the nail is bent down as the device is forced down and in the other the nail slides free of the nail without contacting the nail. The post can then be lifted vertically such that the nail slides free of the device.

11 Claims, 3 Drawing Sheets

FIG. 8
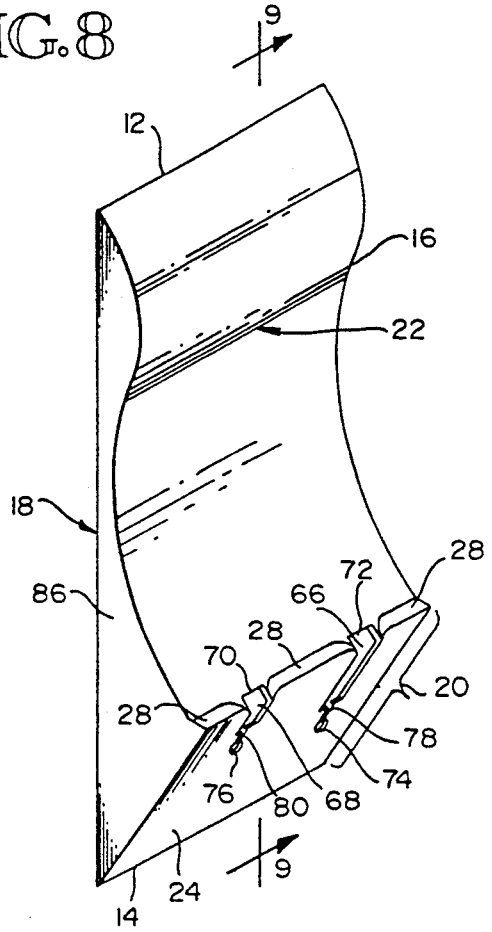
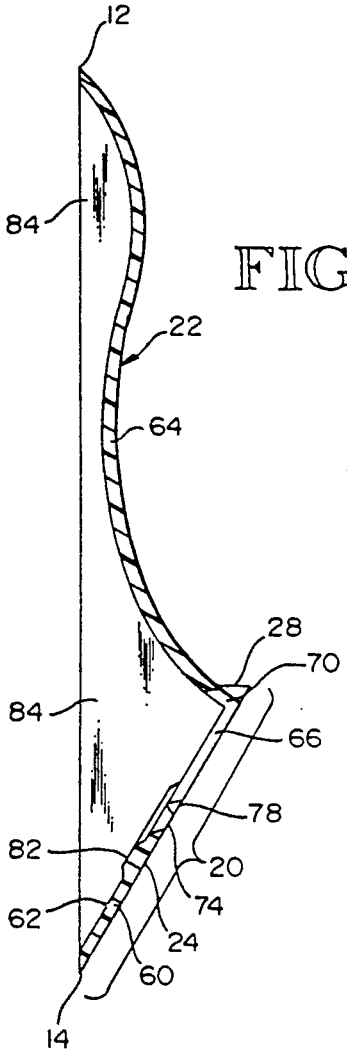
FIG. 9
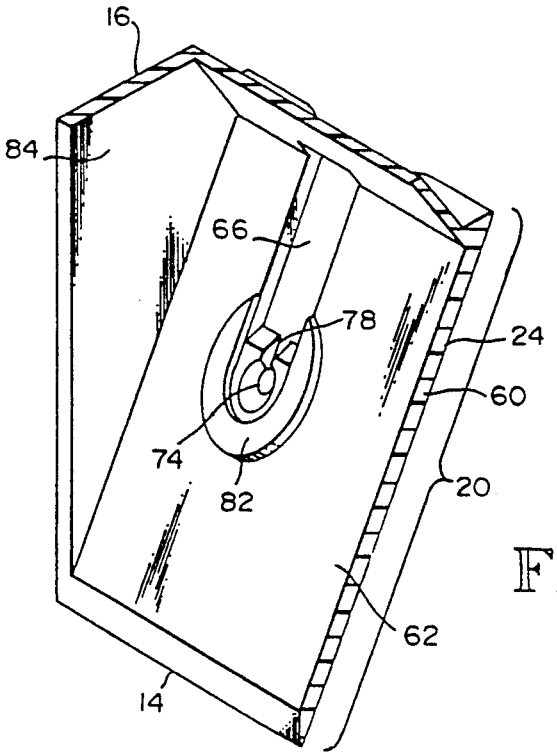
FIG. 10

RELEASABLE POST ANCHORING DEVICE

TECHNICAL FIELD

The invention relates to the field of structures for anchoring in-ground mounted posts and the like and more particularly to a quick-releasable post anchoring attachment which enables workman to install and remove a post or pole quickly.

BACKGROUND ART

As those skilled in the art are aware governmental and municipal agencies have long been plagued by vandalism of street and traffic signs. The type of damage caused by vandals includes uprooting a sign post, knocking the sign over, defacing the sign held by the post and other forms of malicious and mindless property damage. Where, for instance, a post is simply broken in two so that a stub must be removed, the amount of effort and time required of the workmen who must remove the stub and replace the sign post may be considerable. This is particularly so if the broken post had some type of old and well known anchor means attached. In such a case the amount of digging required of the crew will be substantial. The same is true of any post which must be removed whatever the reason may be.

The known means of providing an anchoring feature for a post include a number of spikes pounded into and protruding from the part of the post which is below ground. Another old anchoring method includes nailing pieces of board such as short lengths of 2×4 to the butt of the post. As may be appreciated a large hole must be dug in order to remove a post with these kinds of locking structures attached. Accordingly, governmental entities incur large annual expenses for labor, post materials, sign maintenance, repair and replacement.

It must be kept in mind that many municipalities have ordinances which require that certain types of signs must be replaced within a specified number of hours. It can be understood that certain signs are necessary to public safety and are therefore important.

The only known art pertaining to the instant invention includes U.S. Pat. No. 4,522,530 to Arthur which is directed to a self-erecting marking post. This prior art device utilizes a lower end portion which carries outwardly projecting spring fingers which positively lock into the ground. The structure and intent of the patented device is significantly different and distinct from the device of this application. Other United States Patents are U.S. Pat. Nos. 4,106,879; 353,050; 319,823; and 1,038,147, none of which is pertinent to the instant device.

SUMMARY OF THE INVENTION

The invention comprises an elongated plastic body with a lower post attachment section which is nailed to the underground end of a post. An upper anchoring section extends upwardly and outwardly from the attachment end. The nails are received in holes separated from openings either by a web or by restricted slits. Upward force on the post for removal is prevented by the one or more anchoring devices attached to the post. Removal is permitted by downward striking of the anchor device by a bar such that the anchor device is forced down relative to the post. Striking the anchor device down breaks the web or slips the device down through a restricted slit to separate the anchor from the post. The elongated opening above serves to bend or to allow the anchor device to slide free of the projecting nail. The post may then be pulled up free of the anchor.

Accordingly, it is among the many features of the invention to provide an anchor device for sign and marker posts which is uniquely simple, inexpensive, rugged and extremely effective. The invention can be rapidly attached and released by simply striking the anchor adjacent the post and thusly to break a web or to slide the device past a projecting nail through the restricted slit and thence to clear the device because of the elongated opening above the nail holes. The post may then be lifted free of the anchor. The invention minimizes worker time for post removal and replacement and yet is highly effective. The quick-release feature does not require an special tool or equipment. The quick-release is accomplished by use of a sign installer's bar carried on service trucks and vehicles. Unauthorized persons do not usually have access to a post installer's bar so that it is difficult if not impossible for vandals to effect release of the post even if they are aware an anchor is secured to the post.

BRIEF DESCRIPTION OF THE DRAWINGS

FIG. 8 is view in perspective showing a slightly different embodiment of the invention;

FIG. 9 is a side elevational view taken along the line 9—9 of FIG. 8 illustrating additional details of its construction; and FIG. 10 is a partial view in perspective with a portion broken away to show details of the configuration of FIGS. 8 and 9.

BEST MODE FOR CARRYING OUT THE INVENTION

Figure 1:
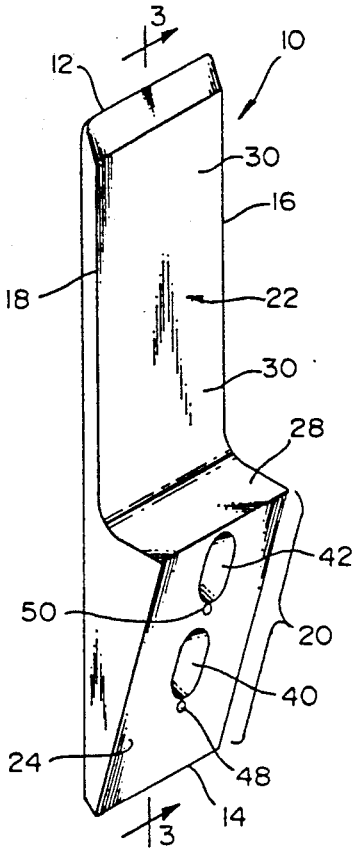
FIG. 1 is a view in perspective of the anchor device showing the side which abuts the post.

Referring now to the drawings it will be noted that the post anchoring device of this invention , generally designated by the number 10, is an integral plastic body member about a foot long and approximately 2½ inches wide. Dimensions mentioned here are typical and not limiting since the device may vary in size. The body member 10 has upper end 12, lower end 14, and side edges 16 and 18.

The anchor has a lower post attachment section 20 which constitutes a little less than half the length of device 10. An upper anchor section is generally identified by the number 22 and extends upwardly and outwardly at an angle from the lower section 20 and away from the post. Post attachment section 20 includes a contact or abutment surface 24 which abuts post P to which the device is secured and also includes a planar outside surface 26 in the embodiment of FIGS. 1 through 7 and which surface 26 forms the outer surface of both the lower and upper sections 20 and 22. The post attachment or lower section as can be seen is triangular so that a generally offset surface 28 is formed between abutment surface 24 and the inside surface 30 of the upper anchor section 22. On the outside of the lower attachment section 20 is a cavity defined by offset ledge 32 and bottom cavity surface 34 which is generally parallel to post contact or abutment surface 24. Side surfaces 36 complete the cavity. Surfaces 24 and 34 form abutment wall 38 which for purposes of illustration may be about ½ inch thick.

In abutment wall 38 are two openings 40 and 42 spaced one above the other. Again, and for purposes of illustration only, the openings 40 and 42 are about ¾ if an inch from top to bottom on the cavity surface side 34 of wall 38 and are not necessarily round. The dimensions of cavities 40 and 42 are illustrative only. The openings from the outside or cavity surface 34 angle upwardly and inwardly to surface 24 to form rounded deflection surfaces 44 and 46 respectively at the top of the openings. The purpose and function of the deflections surfaces 44 and 46 will be be explained more fully hereinafter.

Figure 4:
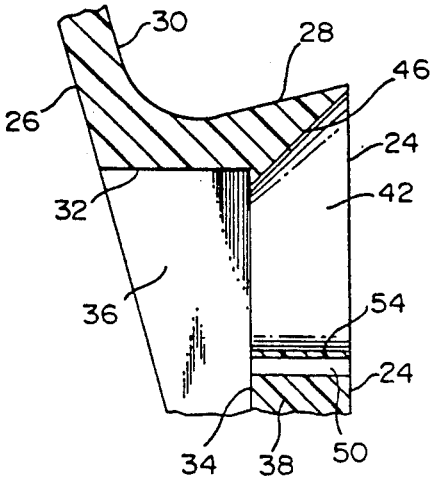
FIG. 4 is a partial cross-section view of the invention showing additional details of construction.
Figure 5:
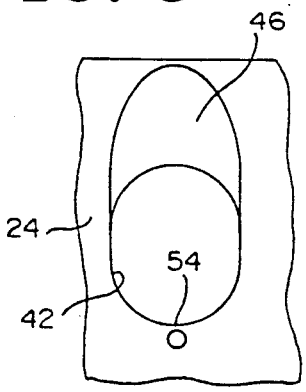
FIGS. 5 and 6 are partial views in elevation showing additional details.
Figure 6:
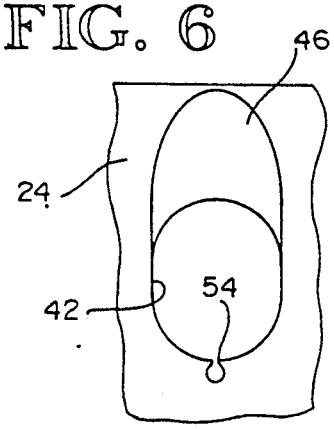

Just below each opening 40 and 42 is a separate nail hole 48 or 50 separated from its main opening by web portions 52 and 54. the web portions 52 and 54 are spaced a predetermined distance below and centered with respect to the main openings so that the web portions are rupturable or can be broken by the blow of a bar on the device as shown. FIGS. 4 to 6 show only the upper opening 42 and its related nail hole 50 but are representative of the structure and function of the lower opening 40 and its nail hole 48.

Figure 3:
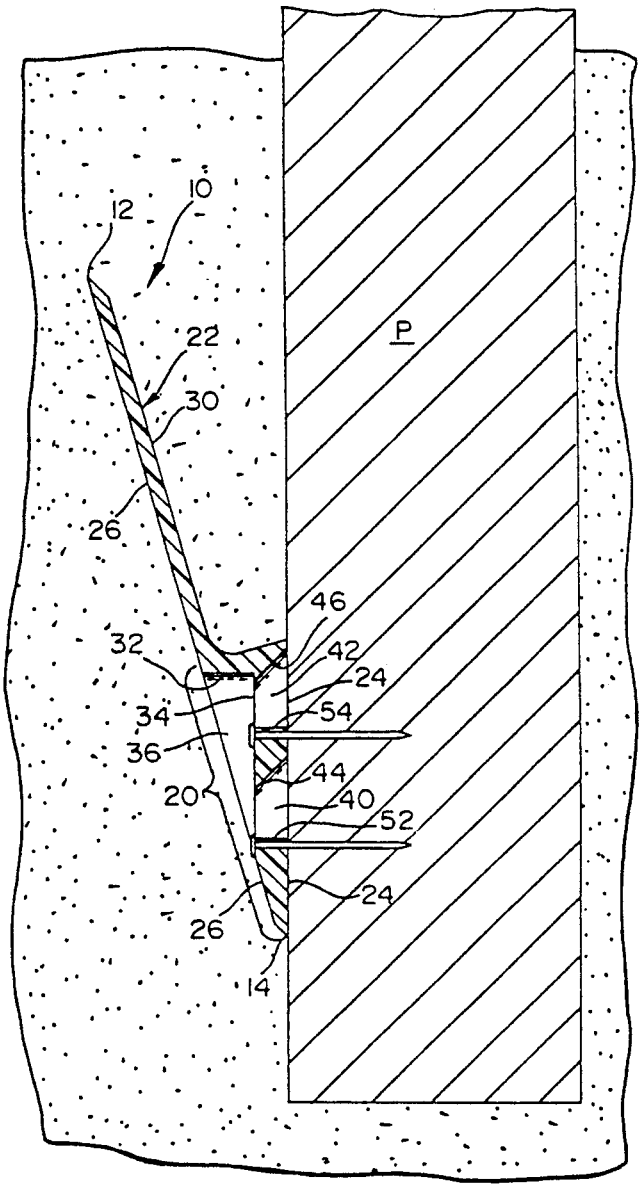
FIG. 3 is a partial cross-section view in elevation taken along the line 3—3 and showing additional details of the device attached to a post.
Figure 2:
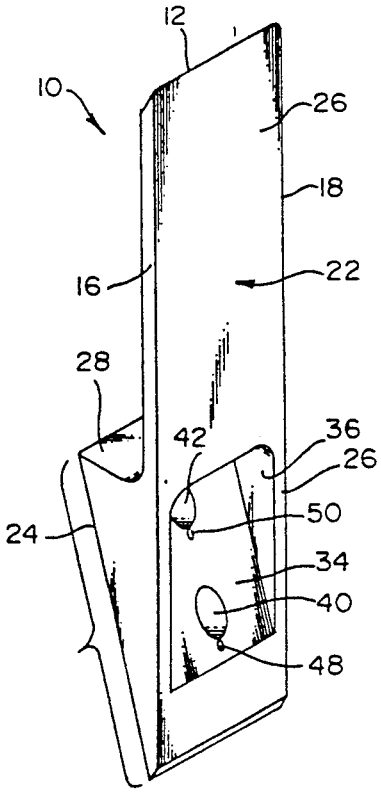
FIG. 2 is also a view in perspective showing the side of the anchor body facing away from the post.

In use the post anchoring device is attached by a pair of 6 or 8 penny box nails to the lower end of a post as shown in FIG. 3. The nails are driven through holes and 50 to securely attach the anchor to the post. It will be appreciated that the posts commonly are 4×4 or 6×6 wooden members which support a wide variety of street, traffic and marker signs. One or more anchors may be attached though only one is shown for the sake of simplicity. Such posts are usually placed in the ground to a depth of about 30 inches.

Figure 7:
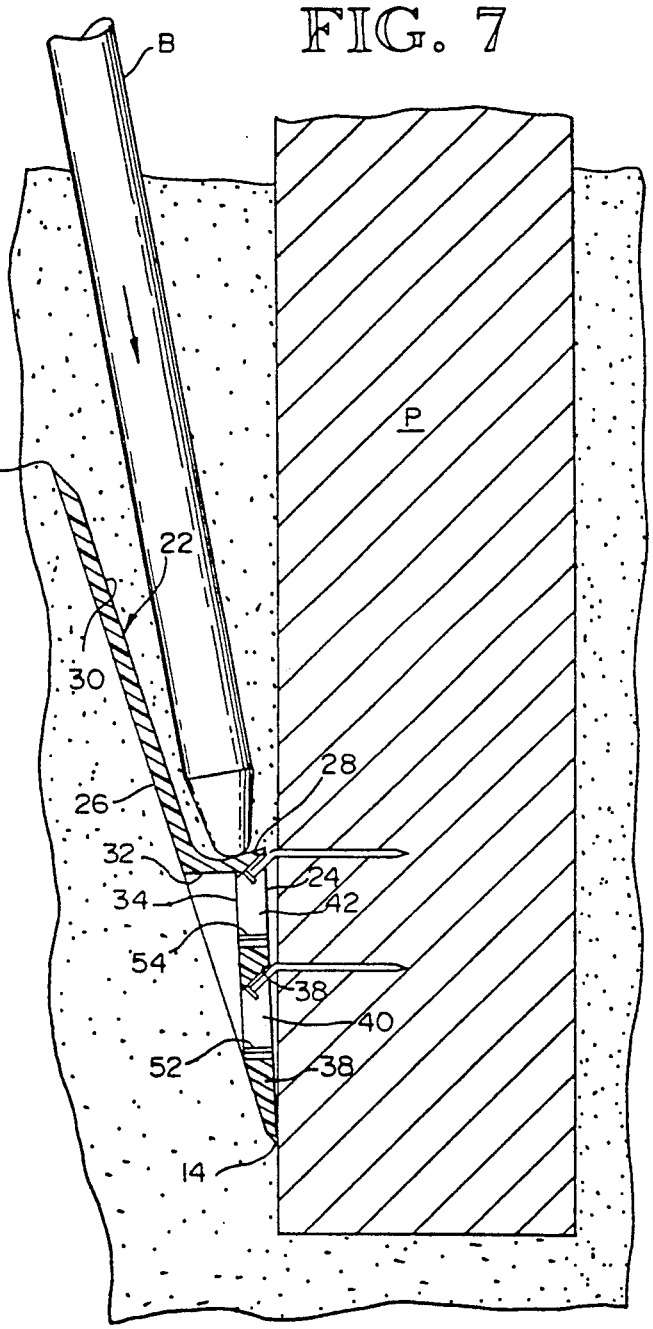
FIG. 7 is a side elevation cross-sectional view showing additional details of construction of the invention.

If the sign has been damaged or if for some reason the post must be replaced, the sign replacement crew need only take a steel bar B, apply a few sharp downward blows of the bar end on offset surface 28. The webs 52 and 54 are broken by the blows forcing the anchor device down relative to the post. Forcing the device down brings angled surfaces 44 and 46 into contact with the protruding portion of the nails and bends the nails down as shown in FIG. 7. The post itself is then free of the anchor device or devices and may be lifted out of the ground separately. The anchor devices may then be retrieved. A minimum amount of digging is required to prepare a hole for a new post which is also provided with one or more anchoring devices 10. the invention can be made with an arcuate or rounded shape to adapt to round posts. Also, if the post is metal, whether round or square, self-drilling and tapping screws would be used instead of nails.

The slightly different structural form shown in FIGS. 8–10 is lighter by designing the device with thinner wall portions and by incorporating rounded sections in the interest of making it a more moldable product. Thus, the post abutment section 20 has wall 60 with abutment surface 24 and interior surface 62. The upper anchor section 22 has curved wall 64 which as mentioned above is of a thinner cross section than shown in the planar form of anchoring section 22. An offset surface 28, because of the curvatures of the anchoring section, is less pronounced than surface 28 of the first embodiment but serves the same function. In this embodiment two openings 66 and 68 are provided and are located laterally of each other rather than one above the other. It is seen that elongated opening 66 is lightly longer than opening 68. Both openings however extend upwardly and through wall 60 and for a short distance as at 70 and 72 in the very lower part of wall 64. Thus the offset surface 28 is broken into three sections by the openings. In this instance the openings 66,70 and 68,72 are formed to allow the device to slide free of the nails without any attempt to bend the nails. It will be noted that nail holes 74 and 76 are located a predetermined short distance below the lower end of each of the openings and that instead of being separated by thin webs from the openings are separated by narrow slits 78 and 80. In addition each of the two nail holes 74 and 76 on the surface 62 are provided with raised rounded U-shaped clearance area 82 which extends from each side of the opening and around the nail holes 74 and 76. This raised clearance area prevents a nail head from being too deeply embedded. Stated another way it acts as a buffer to help establish a workable depth to which a nail may be pounded. Thus, the protruding nail head easily clears the opening when the anchor device is struck to be forced down. It will be observed that side walls 84 and 86 are provided at the sides to strengthen the thinner walls of the abutment and anchor sections.

It is to be understood that a special tool may be employed to move the post up relative to the anchor device and to disengage it therefrom. Since it requires about 175 pounds of pull at least to remove a post, such a tool would have to be capable of exerting much more vertical pull than a human being. Thus, a tool can be an alternative to using a bar to move the anchor down relative to the post.

I claim:

1. A detachable anchoring device for posts and the like, comprising:

a) an elongated, generally rectangular body member having upper and lower ends and side edges and including a lower post attachment section and an upper anchor section extending upwardly away from said attachment section, b) said lower post attachment section including an abutment wall having a post contacting inner surface and outer surface and further including an offset release surface extending from said said post contacting inner surface to said upper anchor section such that a striking surface is defined which extends generally outwardly away from said post, said lower post attachment section also including at least one opening through said abutment wall and having a nail hole spaced in close proximity to the lower edge of said opening to define a breakable web portion of predetermined thickness between said opening and said nail hole whereby at least one nail is used to hold said anchor device against said post, and c) said upper anchor section extends upwardly and outwardly away from said post and from said lower post attachment section at a predetermined angle such that said offset striking surface is presented to be struck from above by bar means to force said device down and break said web portion and bend said nail head so that said post is separated from and may be lifted free of said anchoring device.

2. The anchoring device according to claim 1 and wherein said opening in said abutment wall is shaped so that an upwardly and inwardly angling deflection surface is defined for engaging the protruding portion of a nail and to bend the said nail down as the anchor device is forced down with respect to said post.

3. The anchoring device according to claim 1 and wherein two said openings and two said nail holes are located in spaced relation to each other in said abutment wall of said attachment section.

4. The anchoring device according to claim 1 and wherein said upper anchor section is a generally rectangular, flat planar member.

5. The anchoring device according to claim 2 and wherein two said openings and two said nail holes are located in spaced relation to one another in said abutment wall of said post attachment section.

6. The anchoring device according to claim 5 and wherein said upper anchor section is a generally rectangular, flat planar member.

7. A detachable anchoring device for posts and the like, comprising:

a) an elongated, generally rectangular body member having upper and lower ends and side edges and including a lower post attachment section and an upper anchor section extending upwardly away from said attachment section, b) said lower post attachment section including an abutment wall having a post contacting inner surface and an outer surface and further including an offset release surface extending from said post contacting inner surface to said upper anchor section such that a striking surface is defined which extends generally outwardly away from said post, said lower post attachment section also including at least one opening through said abutment wall and having a nail hole spaced in close proximity to the lower edge of said opening and further having a restricted nail slit between said opening and said nail hole whereby at least one nail is used to hold said anchor device against said post, and c) said upper anchor section extends upwardly and outwardly away from said post and from said lower post attachment section at a predetermined angle such that said offset striking surface is presented to be struck from above by bar means to force said device down such that said nail slides through said restricted slit and into said opening so that said post is separated from and may be lifted free of said anchor device.

8. The anchoring device according to claim 7 and wherein said opening in said abutment wall is shaped so that it extends upwardly to and into said offset release surface to permit said device to slide free of said nail.

9. The anchoring device according to claim 8 and wherein two said openings and two said nail holes are located one spaced laterally of the other in said abutment wall of said post attachment section.

10. The anchoring device according to claim 7 and wherein said upper anchor section is a generally rectangular, curved member.

11. The anchoring device according to claim 7 and wherein said lower attachment section has a raised clearance area around said nail hole to prevent too deep an embedment of said nail.

* * * * *